US008701974B2

(12) United States Patent
Davies et al.

(10) Patent No.: US 8,701,974 B2
(45) Date of Patent: Apr. 22, 2014

(54) CARTON HAVING FIRST AND SECOND PATTERNS OF WEAKNESS

(75) Inventors: Philip Davies, Mount Waverley (AU); Silvio Bugelli, Mount Waverley (AU)

(73) Assignee: Cadbury Enterprises PTE Limited, Jurong (SG)

( * ) Notice: Subject to any disclaimer, the term of this patent is extended or adjusted under 35 U.S.C. 154(b) by 0 days.

(21) Appl. No.: 13/354,590

(22) Filed: Jan. 20, 2012

(65) Prior Publication Data

US 2012/0138669 A1 Jun. 7, 2012

Related U.S. Application Data

(63) Continuation of application No. 13/132,725, filed as application No. PCT/AU2009/001579 on Dec. 4, 2009, now abandoned.

(30) Foreign Application Priority Data

Dec. 4, 2008 (AU) ..... 2008906290

(51) Int. Cl.

| | |
|---|---|
| ***B65D 5/54*** | (2006.01) |
| ***B65D 5/64*** | (2006.01) |
| ***B65D 5/20*** | (2006.01) |
| ***B65D 85/60*** | (2006.01) |

(52) U.S. Cl.
USPC ..... 229/102; 229/223

(58) Field of Classification Search
USPC ..... 229/102, 221, 223, 228
See application file for complete search history.

(56) References Cited

U.S. PATENT DOCUMENTS

| | | | | |
|---|---|---|---|---|
| 3,253,769 | A | | 5/1966 | Opler |
| 3,368,738 | A | * | 2/1968 | Roccaforte et al. ..... 229/228 |
| 3,438,565 | A | | 4/1969 | Lugt et al. |
| 3,580,466 | A | | 5/1971 | Thelen et al. |
| 4,142,635 | A | | 3/1979 | Capo et al. |
| 4,436,206 | A | * | 3/1984 | Kuchenbecker ..... 206/807 |
| 4,548,318 | A | * | 10/1985 | Boyle ..... 229/221 |
| 4,650,078 | A | | 3/1987 | Desmond et al. |

(Continued)

FOREIGN PATENT DOCUMENTS

| | | | |
|---|---|---|---|
| DE | 19842262 | A1 | 4/1999 |
| EP | 0635431 | B1 | 4/1997 |
| EP | 0 859 275 | A1 | 8/1998 |
| EP | 1 378 456 | A2 | 1/2004 |

OTHER PUBLICATIONS

International Search Report for PCT/AU2009/001579, mailed Feb. 17, 2010.

*Primary Examiner* — Gary Elkins
(74) *Attorney, Agent, or Firm* — Hoffmann & Baron, LLP

(57) ABSTRACT

A carton has a closure flap (18, FIG. 4) held in a closed condition prior to initial opening of the carton by a connection between a face of the closure flap and an opposing face of an adjacent wall (4) of the carton. The flap is connected is to a part (30) of the adjacent wall which is removable from the remainder of that wall along one or more first patterns of weakness (32). The connection being in a predetermined zone (34) of the removable part defined by one or more second patterns of weakness (36) so that when the part (30) is removed from the remainder of the wall (4), the predetermined zone (34) can be separated from the remainder of the part (30) along the second pattern(s) of weakness (36) to remain attached to the closure flap. The carton may be formed from a blank (10, FIG. 4).

20 Claims, 7 Drawing Sheets

(56) References Cited

U.S. PATENT DOCUMENTS

| | | | | |
|---|---|---|---|---|
| 5,000,320 | A * | 3/1991 | Kuchenbecker | 229/221 |
| 5,014,855 | A * | 5/1991 | Roccaforte | 229/228 |
| 5,036,983 | A | 8/1991 | Thykeson | |
| 5,044,503 | A * | 9/1991 | Wein | 229/221 |
| 6,209,785 | B1 * | 4/2001 | Ben-Haim | 229/223 |
| 2002/0066778 | A1 * | 6/2002 | Heeley et al. | 229/221 |
| 2006/0283928 | A1 | 12/2006 | Walsh et al. | |
| 2007/0102499 | A1 * | 5/2007 | Lo Duca | 229/223 |

* cited by examiner

CARTON HAVING FIRST AND SECOND PATTERNS OF WEAKNESS

CROSS-REFERENCE TO RELATED APPLICATIONS

This application is a continuation of U.S. patent application No. 13/132,725, filed Jun. 3, 2011, which is the National Stage of International Application No. PCT/AU2009/001579, which designates the U.S., filed Dec. 4, 2009 which claims the benefit of Australian Patent Application No. AU2008906290, filed Dec. 4, 2008, the contents of which are incorporated by reference herein.

TECHNICAL FIELD OF THE INVENTION

The present invention relates to a carton and more particularly to a closure system of a carton. In one preferred embodiment, the carton is for a solid confectionary block such as a chocolate block.

BACKGROUND TO THE INVENTION

Although chocolate blocks are traditionally packaged within an outer wrapping of paper or foil, alternatively they may be packaged within an outer carton composed of a thin board. Previous carton designs proposed for this purpose have a closure in the form of an end flap which, in the unopened carton, is retained by gluing to an adjacent wall of the carton. These existing closure arrangements are not particularly easy to open especially by older persons or less dextrous persons and, likewise, the flap may not always be easy to close after opening. The difficulties are such that some consumers simply tear open the carton and which is easy to do as the carton is quite thin, but once torn open in this way the carton cannot be properly reclosed and also, having been torn, is quite unsightly.

The present invention seeks to provide a carton of the general type discussed above with an improved opening and re-closure facility.

SUMMARY OF THE INVENTION

According to the present invention there is provided a carton erected from a blank, the carton having a closure flap held in a closed condition prior to initial opening of the carton by a connection between a face of the closure flap and an opposing face of an adjacent wall of the carton, wherein the connection is to a part of the adjacent wall which is removable from the remainder of that wall along one or more first patterns of weakness, the connection being in a predetermined zone of the removable part defined by one or more second patterns of weakness so that when the part is removed from the remainder of the wall, the predetermined zone can be separated the remainder of the removable part along the second pattern(s) of weakness to remain attached to the closure flap.

In a carton in accordance with this aspect of the invention, separation of the removable part from the wall along the first pattern(s) of weakness may also cause the connected zone to separate from the part along its associated second pattern(s) of weakness. To ease the separation of the connected zone, it may be defined by a pattern of weakness of a continuously curved profile such as elliptical or circular. In alternative configurations, it may not be a continuously curved profile.

The connected zone may provide the only zone of connection between the closure flap and the adjacent wall of the carton prior to initial opening.

When the part of the adjacent wall is removed as defined above to permit release of the closure flap, a recess of corresponding shape is formed in the wall and in one embodiment of the invention, the closure flap is so configured that after its release it can be reclosed by tucking a free edge of the flap behind an edge of the recess. The recess may open onto an outer edge of the wall, and prior to initial opening of the carton the flap may be located inside of that outer edge, whereas to reclose the carton after initial opening the configuration of the flap may be such that a free edge portion of the flap is able to engage behind an edge of the recess inwardly of the outer edge of the wall. The closure flap may be connected along one edge with a panel forming a further wall of the carton, the free edge portion of the flap being distal from said one edge. To aid in retaining the free edge of the flap, the flap may be shaped to provide a first zone of constant width immediately adjacent the panel, the flap progressively narrowing in a direction away from the panel to a second zone of constant width and narrowing progressively from the second zone of constant width towards the free edge. The first zone of constant width may have a width which is substantially the same as that of the panel.

The carton may be erected from a blank and in one form, the carton is erected by folding the blank around a product to be packaged within a carton, a confectionary block for example. In this form, the retention of the flap by a glued connection prior to opening is particularly convenient as the actions of folding a blank around a product in a production line situation and applying glue to predetermined parts of the blank during the process can readily be performed by existing commercially available machinery.

Alternatively, however, the flap could be retained in other ways, such as by double-sided adhesive tape or by mechanical retention such as stapled or riveted connection or a frictional connection. Certain of these retention methods may be more applicable in a situation where the carton is pre-formed prior to insertion of the product.

According to a further aspect of the invention there is provided a blank for erection into a carton, the blank having panels foldable to form walls of the carton, and a flap foldable for closing an access opening of a carton whereby in the erected carton the flap is retained prior to initial opening by connection to part of an adjacent wall of the erected carton, the said part of the wall being formed by a part of one of said panels which is removable from that panel along one or more first patterns of weakness to permit release of the flap, wherein the said part of the said one panel includes a zone defined by one or more second patterns of weakness whereby when, in the erected carton, the flap is connected to the said one panel in that zone, release of the flap to open the carton can be effected by removal of the said part of the panel and separation of the said zone from the part.

The said zone may be of a continuously curved profile such as elliptical or circular.

The said part of said one panel may be of generally rectangular shape. In which case, at least one edge of the said part is defined by an edge of the panel. In one embodiment, two adjacent edges of the said part are defined by two adjacent edges of the said one panel forming a corner portion of the panel. The said part may include a projecting tab to facilitate its removal.

In one embodiment, the closure flap is connected along one edge with a further panel which in the erected carton forms a further wall of the carton, the flap having a free edge region distal from said one edge, the closure flap being shaped to provide a first zone of constant width immediately adjacent the said further panel, the flap progressively narrowing in a direction away from the said further panel to a second zone of constant width and narrowing progressively from the second zone of constant width towards the free edge. The first zone of constant width may have a width which is substantially the same as that of the said further panel.

According to yet another aspect of the invention there is provided a method of erecting a carton from a blank as specified above, comprising placing a product to be packaged on a panel of the blank other than said one panel and sequentially folding other panels around the product to enclose the product, wherein the said flap is folded over the product prior to folding the said one panel over the product, and the said one panel is subsequently folded over the product to overlie the flap, the method further comprising connecting the said part of the said one panel to the flap in said zone to thereby retain the flap thereto.

Advantageously, the method comprises applying glue to connect the said part of the said one panel to the flap, and applying glue to other parts of the blank to connect adjacent folded parts and maintain the carton in its erected state.

DETAILED DESCRIPTION OF THE INVENTION

An embodiment of the invention will now be described by way of example only with reference to the accompanying drawings in which.

Figure 1:
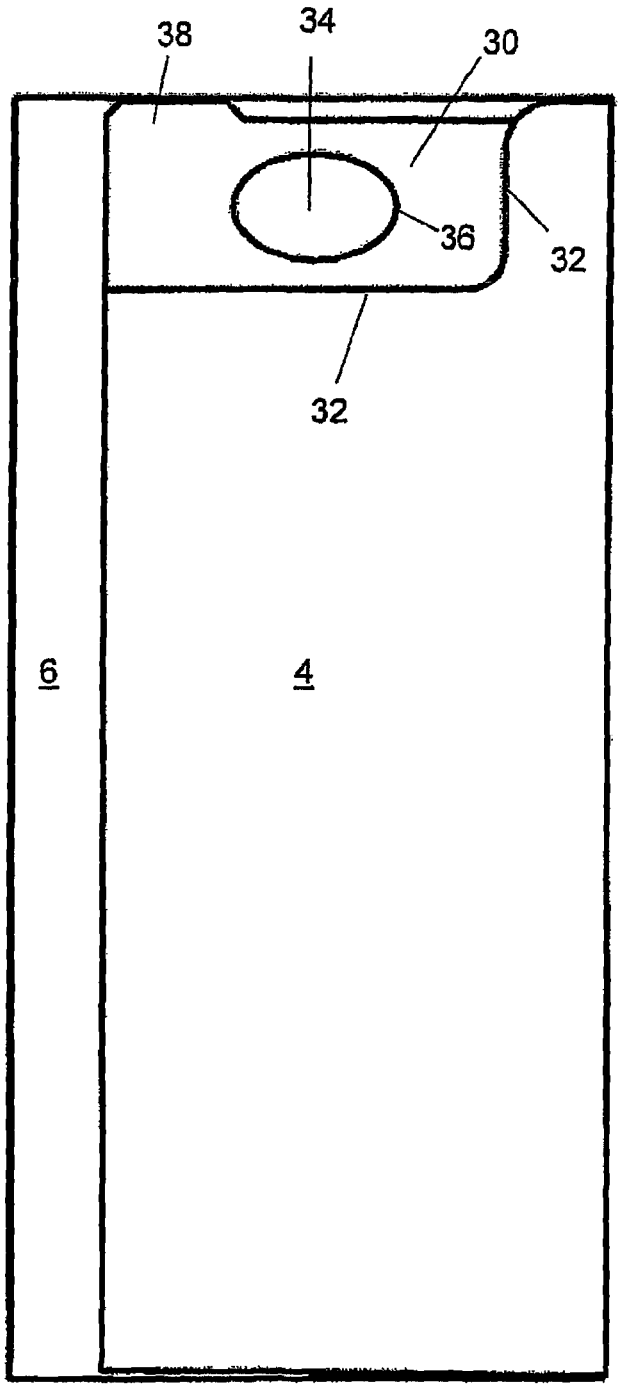
FIG. 1 is a view from the rear of the carton in accordance with a preferred embodiment of the invention.
Figure 2:
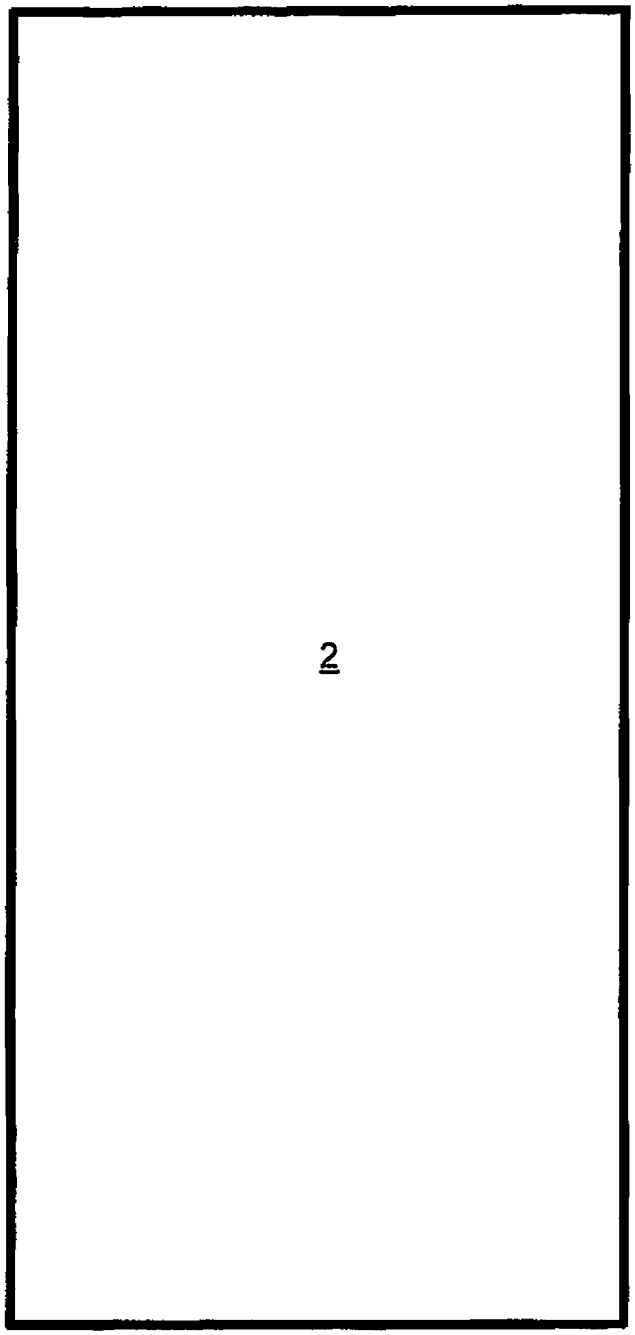
FIG. 2 is a view from the front of the carton.
Figure 3:
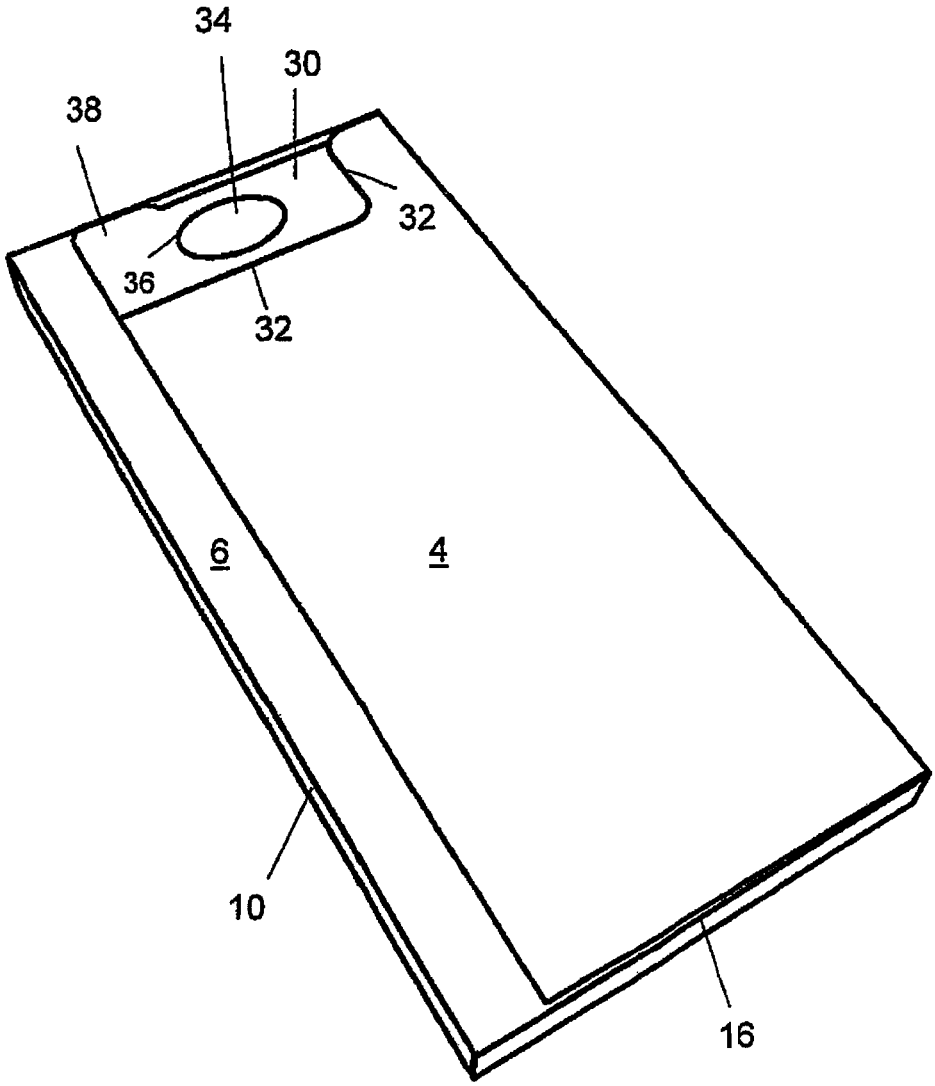
FIG. 3 is a perspective view showing the rear of the carton.
Figure 4:
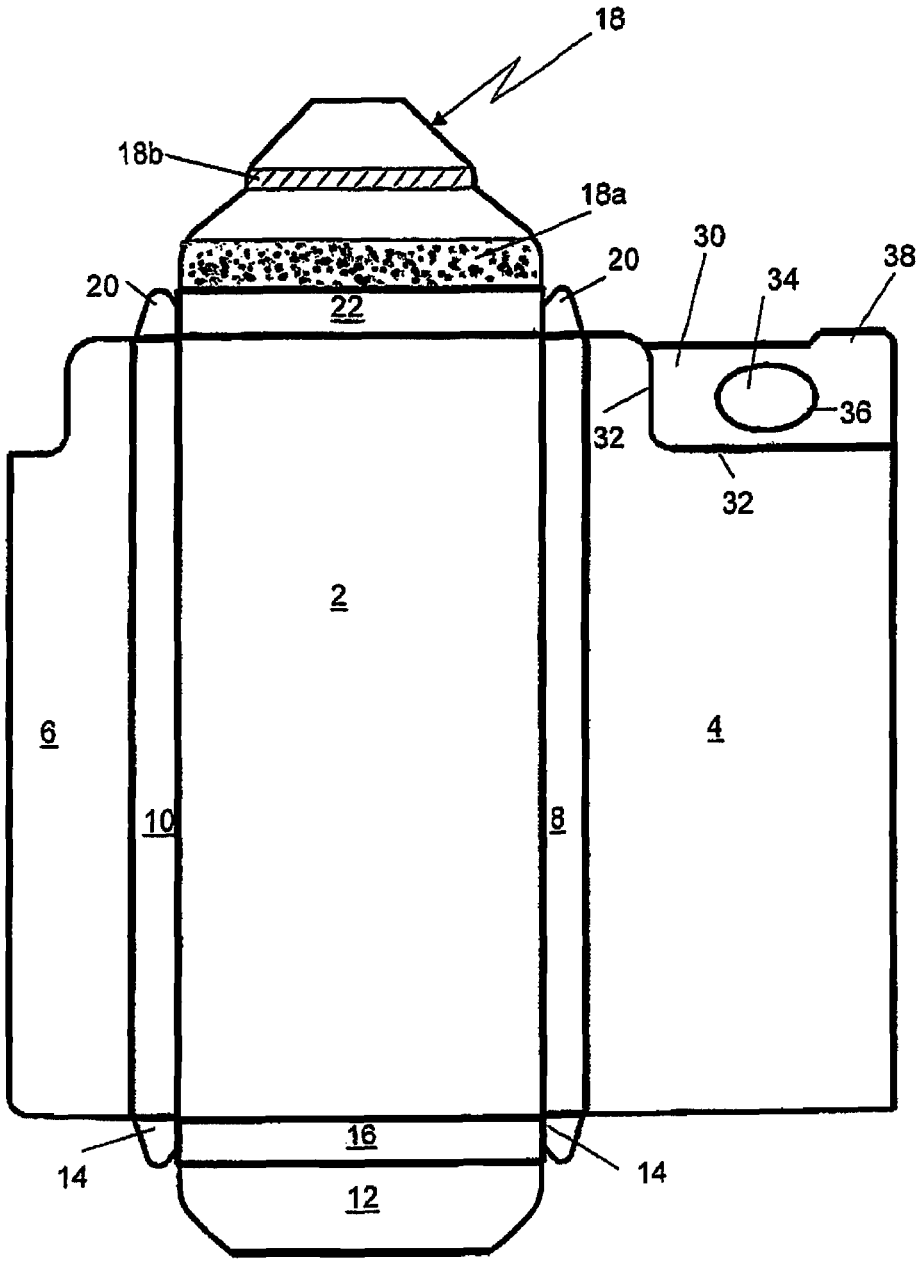
FIG. 4 shows a blank of flat board from which the carton is erected.

FIGS. 1 to 3 show the carton prior to opening, the carton being erected from the blank 10 shown in FIG. 4. The blank which is formed from thin board, fibre board for example, comprises a main panel 2 which forms the front wall of the carton and outer side panels 4, 6 which, when the carton is erected, overlap to form the rear wall. The outer side panels 4, 6 are connected to the main panel 2 by narrow intermediate panels 8, 10 which form the opposite side walls of the erected carton. A lower closure flap 12, associated tabs 14, and a narrow intermediate panel 16 between flap 12 and panel 2 form a lower closure. An upper closure flap 18, associated tabs 20, and narrow intermediate panel 22 form an upper closure.

In practice, a carton of the preferred embodiment is designed to be erected around the product to be enclosed by the carton. When the product is a block confectionary product, a chocolate block for example, the product already enclosed in an inner foil wrapping is placed on the main panel 2 and the other panels and flaps are sequentially folded and adhered together by glue to form the completed carton as illustrated in FIGS. 1 to 3. The general techniques for folding the flaps and applying glue in a production line situation are well known in the packaging industry and do not need to be further described here. In the carton of the preferred embodiment, glue is applied along the edge of one or other of the two outer panels 4, 6 to form an overlapping glued seam which is shown in FIG. 2. The lower closure which is principally formed by the lower closure flap 12 is of substantially conventional construction. The lower closure is intended to remain permanently closed and for this purpose the lower closure flap 12 and intermediate panel 16 is permanently retained in position by gluing of the flap 12 to the inner surface of one or other of the outer panels 4, 6.

The upper closure flap 18 is an openable and re-closable flap to provide access to the contents of the carton. Its construction and its mode of co-operation with the rear wall of the carton prior to opening and upon re-closure will now be described in detail.

With reference to the blank of FIG. 4, it will be seen that the upper closure flap 18 is shaped to provide a zone 18*a* (shown by the stippling in FIG. 4) of constant width immediately adjacent the intermediate panel 22 which forms the upper end wall of the erected, closed, carton. The width of the zone 18*a* corresponds to that of the front panel 2 and hence to that of both the front and rear walls in the erected carton. Beyond the zone 18*a*, the flap 18 then progressively narrows to a second zone 18*b* (shown by the crosshatching in FIG. 4) of constant width and from that second zone 18*b* of constant width, it narrows progressively towards its free end. The function of this second zone 18*b* of the flap 18 will be described later. In the erected carton prior to opening, the flap 18 is retained in its entirety beneath the rear wall formed by the overlapping side panels 4, 6.

The panel 4 includes at its upper end a removable part 30 of generally rectangular shape, the part 30 being joined to the remainder of the panel 4 by first patterns of weakness 32 as exemplified below. Within this removable part 30 is a removable zone 34 which, in the embodiment illustrated, is generally of an elliptical shape but could be of any other shape, circular for example, which achieves the function to be described below. The removable zone 34 is likewise defined by second pattern(s) of weakness 36 as exemplified below.

The first and second patterns of weakness, which may be lines of weakness, may be formed by, for example, perforations or scoring extending only partially through the thickness of the board; such scoring may extend from the inner surface of the board outwards, or the outer surface of board inwards, or a mixture of both. The scoring, perforations or other patterns of weakness may be formed by laser cutting or by mechanical means, for example.

In the erected carton prior to opening, the upper closure flap 18 is retained by gluing only to the rear wall only in the area defined within this small removable zone 34 of elliptical shape. Accordingly, the flap 18 is retained, by gluing, only to the removable part 30 of the rear wall, with the glued connection being confined to within the removable zone 34 of that part 30. With reference to the detailed construction of the flap 18 shown in FIG. 4, the glued connection to the zone 34 is located in the zone of the flap 18 between the zones 18*a* and 18*b*. In the erection of the carton around the product as outlined above, the flap 18 is folded over the product prior to folding the panels 4, 6 which form the rear wall and the glue for providing the connection to the zone 34 can be applied either to the upper face of flap 18 after folding or upper face of the removable part 30 prior to folding of the panel 4.

In order to release the upper closure flap 18 to open the package, the larger removable part 30 is removed from the rear wall by tearing along the first patterns of weakness 32 and during removal of that larger part 30 it will also separate from its glued connection with the upper closure flap 18 by tearing along the second pattern of weakness 36 which separates the inner glued zone 34 from the remainder of the removable part 30. The curved profile of that inner zone readily promotes that action during the separation of the larger part 30. A small tab 38 can be seen to project from the upper edge of the part 30 to facilitate easily gripping that part for the purposes of removal and the tab 38 may carry instructions to the consumer to "OPEN HERE".

Figure 5:
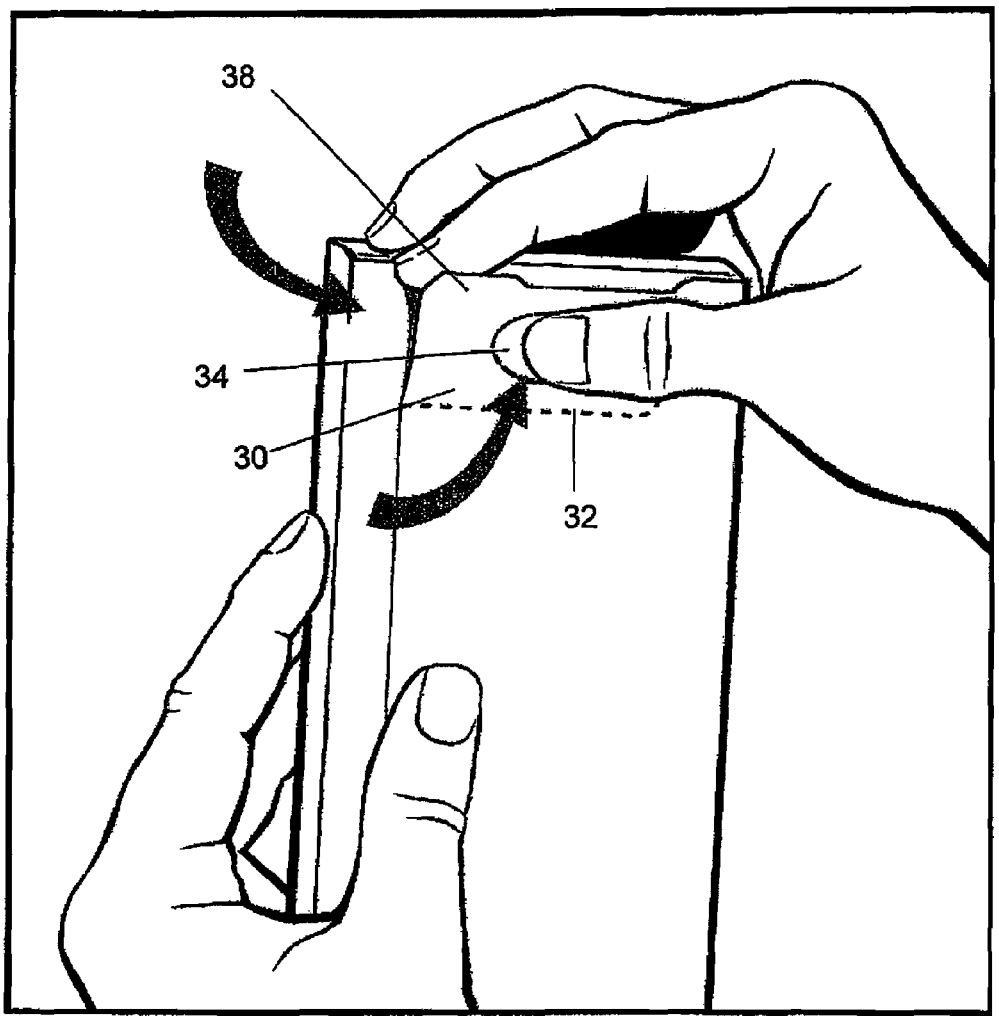
FIGS. 5 and 6 show schematically successive stages in the opening of the carton by removal of a part of the rear wall of the carton to release an upper closure flap.
Figure 6:
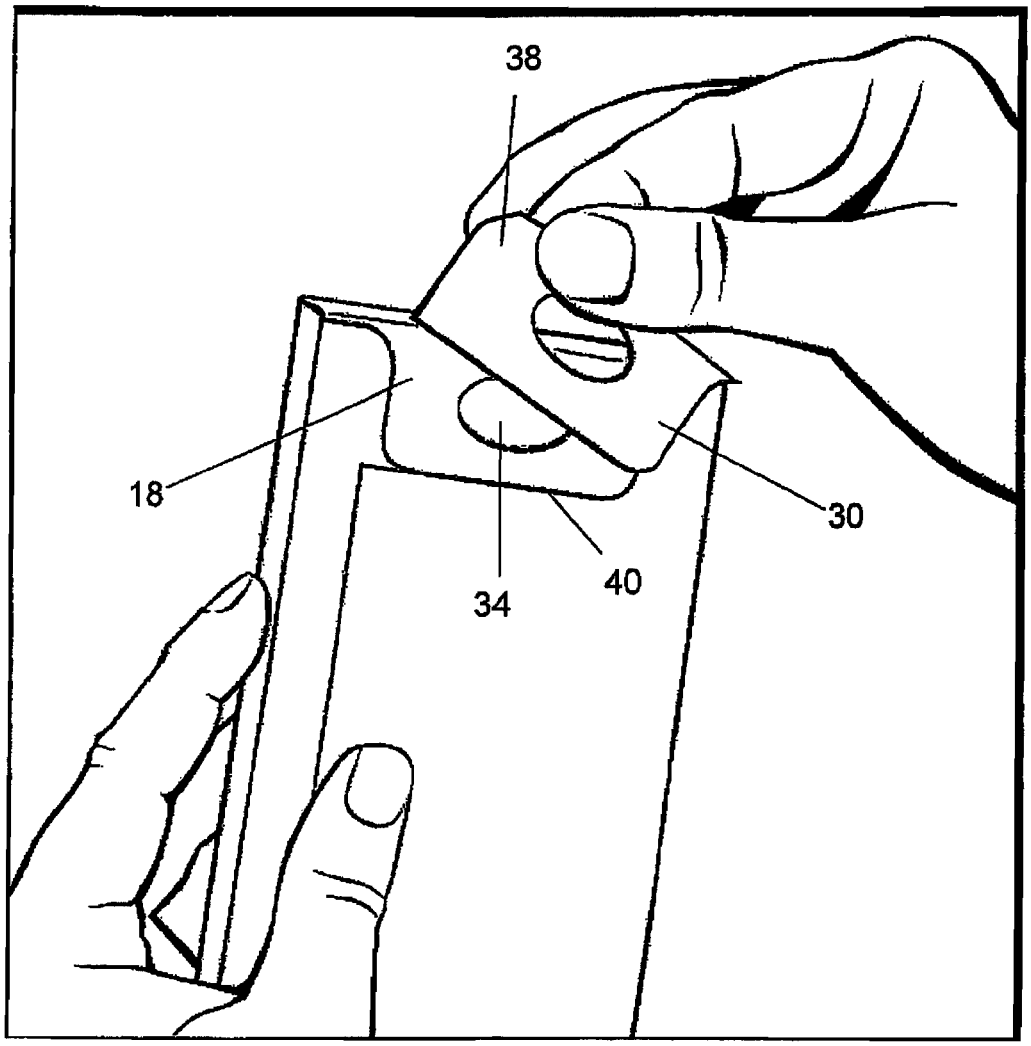

The upper closure configuration described provides firm and secure retention of the upper closure flap 18 prior to opening, but the package can easily be opened by removal of the part 30 by tearing along the defined patterns of weakness as indicated schematically in FIGS. 5 and 6. This has the effect of releasing the upper flap 18 as the glued connection between the flap 18 and the part 30 itself separates from the removed part by easily tearing along the inner pattern of weakness 36. The effect of this is twofold. Firstly, releasing of the flap 18 does not require application of a force sufficient to break the glued connection itself; the force applied merely needs to be sufficient to permit tearing along the various patterns of weakness and the design of these can readily be configured to permit ease of tearing. Secondly, the fact that the glued connection is itself not broken provides a distinct aesthetic element in that no unsightly broken glued connection will be visible when the carton is opened. All that will be visible on the outer surface of the closure flap 18 after opening is the small elliptical (or other shaped) zone 34 which remains glued to the exposed outer surface of the flap 18. That attached zone 34 could, for instance, carry a trade mark applicable to the product in order to provide a sense of aesthetic design integrity to that part of the closure flap 18 after opening.

It will be understood that as the package is designed only to be opened by removing the part 30 of the rear wall in the manner described and which will require complete separation of the inner zone 34 and at least substantial separation of the overall part 30 from the rear wall, the state of the part 30, either absent or at least substantially separated, will immediately provide clear visual evidence of tamper and conversely even upon casual inspection it should be immediately apparent that the presence of the part 30 without any tearing should indicate that there has in all probability been no tampering with the package.

As the part 30 is quite "cleanly" removable from the carton and has a relatively significant size, it can also be used as a token redeemable for promotional activities. For example the part 30 may be printed on its inside surface, that is the surface not visible to the consumer prior to opening the carton, with indicia concerning a prize which can be obtained when the token is redeemed; it will be understood that in this case the indicia must appear within the area outside of the inner removable zone 34.

Figure 7:
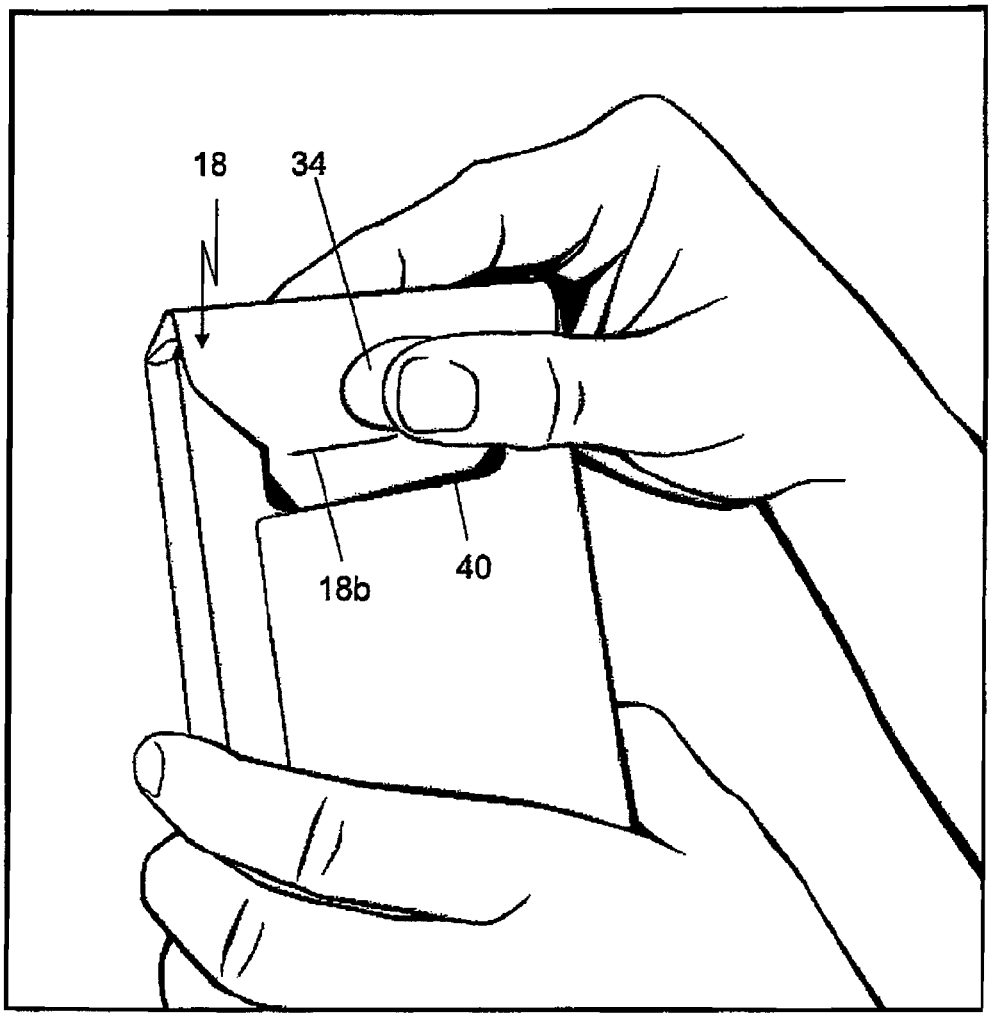
FIG. 7 shows schematically how the upper closure flap can be reclosed following opening.

When the part 30 has been removed to permit release of the upper closure flap 18, a recess of approximately rectangular shape will be left in the upper edge part of the rear wall and this is shown in FIG. 6. It will be seen that the recess is bounded on opposite sides by the remaining portions of the rear wall. Although the carton could be reclosed after opening by tucking the closure flap 18 under those remaining portions, that is rather cumbersome. Instead the flap 18 is designed to be reclosed by folding the flap 18 back over the rear wall so that the main body of the flap 18 lies on the outside of the rear wall rather than on the inside of the rear wall as occurred during initial erection and sealing of the carton. In this state the flap 18 can then be retained in its closed state by tucking the narrowed free end part of the flap 18 beneath the lower edge 40 of the recess now present in the rear wall (this is shown in FIG. 7). This effect is facilitated by the presence of the secondary zone 18*b* of constant width, the width of this being slightly less than the width of the recess itself.

It will be noted that in the particular design shown in the drawings, the main removable part 30 of the rear wall extends to the upper edge of the panel 4 and side edge of the panel so that the part 30 defines a corner portion of the panel 4. Although this is preferred as its removal merely requires tearing along two principal patterns of weakness, one at right angles to the other and interconnected by a radiused portion to facilitate a smooth tearing action, nevertheless in alternative forms the removable part could be positioned more centrally within that panel.

The embodiment has been described by way of example only and modifications are possible within the scope of the invention. For example although as shown, the closure system is associated with one of the two ends of the carton, specifically the upper end, in other embodiments it could be associated with one or other of the two sides of the carton.

Although as described, the carton is erected by folding around the product, it may alternatively be pre-formed prior to insertion of the product(s) to be contained therein. As an alternative to gluing the inner removable zone 34 to the closure flap 18 it may be secured thereto in alternative ways such as by the use of double-sided adhesive tape or by a mechanical fastening such as a staple, rivet or frictional connection. Certain of these alternatives may however only be applicable for use in a pre-formed carton.

Although the invention has been particularly described with reference to a carton for a confectionary product such as chocolate in block form it is to be understood that the closure system described herein could be used in cartons for a variety of different products.

The invention claimed is:

1. A carton having a closure flap held in a closed condition prior to initial opening of the carton by a connection between a face of the closure flap and an opposing inner face of an adjacent wall of the carton, wherein the connection is solely to a part of the adjacent wall which is removable from the remainder of that wall along one or more first patterns of weakness to substantially expose the flap, the connection being in a predetermined zone of the removable part defined by one or more second patterns of weakness so that when the part is removed from the remainder of the wall, the predetermined zone can be separated from the remainder of the removable part along the second pattern(s) of weakness to remain attached to the closure flap.

2. A carton according to claim 1, wherein the connection of the predetermined zone to the face of the closure flap is a glued connection.

3. A carton according to claim 1, wherein the connection of the predetermined zone to the face of the closure flap is a mechanical or frictional connection.

4. A carton according to claim 1, wherein the connected zone provides the only zone of connection between the closure flap and the adjacent wall of the carton prior to initial opening.

5. A carton according to claim 1, wherein the predetermined zone is defined by said second pattern of weakness of a continuously curved profile in the removable part of the adjacent wall.

6. A carton according to claim 1, wherein prior to initial opening of the carton said face of the closure flap is engaged beneath the inner face of the said predetermined zone of the part of the adjacent wall.

7. A carton according to claim 1, wherein removal of the said part of the adjacent wall to permit initial release of the closure flap forms a recess of corresponding shape in the wall, and the closure flap is so configured that after its release it can be reclosed by tucking a free edge portion of the flap behind an edge of the recess.

8. A carton according to claim 7, wherein the recess opens onto an outer edge of the wall, and prior to initial opening of the carton the closure flap is located inside of that outer edge.

9. A carton as claimed in claim 7, wherein the closure flap is connected along one edge with a panel forming a further wall of the carton, the free edge portion of the flap being distal from said one edge.

10. A carton as claimed in claim 9, in which the closure flap is shaped to provide a first zone of constant width immediately adjacent the panel, the flap progressively narrowing in a direction away from the panel to a second zone of constant width and narrowing progressively from the second zone of constant width towards the free edge.

11. A blank for erection into a carton, the blank having panels foldable to form walls of the carton, and a flap foldable for closing an access opening of the carton whereby in the erected carton the flap is retained prior to initial opening solely by connection to an inner part of an adjacent one of said walls of the erected carton, the said part of the wall being formed by a part of one of said panels which is removable from that panel along one or more first patterns of weakness to substantially expose and permit release of the flap, wherein the said part of the said one panel includes a zone defined by one or more second patterns of weakness whereby when, in the erected carton, the flap is connected to the said one panel in that zone, release of the flap to open the carton can be effected by removal of the said part of the panel and separation of the said zone from the part.

12. A blank according to claim 11, wherein the said zone is of a continuously curved profile.

13. A blank according to claim 12, wherein the said part of said one panel is of generally rectangular shape.

14. A blank according to claim 12 wherein at least one edge of the said part is defined by an edge of the panel.

15. A blank according to claim 14, wherein two adjacent edges of the said part are defined by two adjacent edges of the said one panel forming a corner portion of the panel.

16. A blank according to claim 11, wherein the said part includes a projecting tab to facilitate its removal.

17. A blank as claimed in claim 11, wherein the closure flap is connected along one edge with one of said panels which in the erected carton forms one of said panels of the carton, the flap having a free edge region distal from said one edge, the closure flap being shaped to provide a first zone of constant width immediately adjacent the said further panel, the flap progressively narrowing in a direction away from the said further panel to a second zone of constant width and narrowing progressively from the second zone of constant width towards the free edge.

18. A blank as claimed in claim 17, wherein the first zone of constant width has a width which is substantially the same as that of the said further panel.

19. A method of erecting a carton from a blank according to claim 11, comprising placing a product to be packaged on a panel of the blank other than said one panel and sequentially folding other panels around the product to enclose the product, wherein the said flap is folded over the product prior to folding the said one panel over the product, and the said one panel is subsequently folded over the product to overlie the flap, the method further comprising connecting the said part of the said one panel to the flap in said zone to thereby retain the flap thereto.

20. A method according to claim 19, comprising applying glue to connect the said part of the said one panel to the flap, and applying glue to other parts of the blank to connect adjacent folded parts and maintain the carton in its erected state.

* * * * *